United States Patent [19]

Johansson et al.

[11] Patent Number: 4,805,257

[45] Date of Patent: Feb. 21, 1989

[54] DEVICE FOR A VACUUM CLEANER AND A DUST BAG

[75] Inventors: Erik K. G. Johansson, Sollentuna; Lennart K. Fahlen, Märsta, both of Sweden

[73] Assignee: Aktiebolaget Electrolux, Sweden

[21] Appl. No.: 143,342

[22] Filed: Jan. 13, 1988

[30] Foreign Application Priority Data

Jan. 27, 1987 [SE] Sweden ..... 8700312

[51] Int. Cl.[4] ..... A47L 9/14

[52] U.S. Cl. ..... 15/327 R; 15/347; 55/374; 55/502

[58] Field of Search ..... 15/327 F, 347, 327 R, 15/327 E; 55/374, 502

[56] References Cited

U.S. PATENT DOCUMENTS

| | | | |
|---|---|---|---|
| 2,758,668 | 8/1956 | Brace | 55/502 X |
| 3,375,541 | 4/1968 | Fromknecht | 15/327 F |
| 4,469,498 | 9/1984 | Fish | 55/374 X |
| 4,634,527 | 1/1987 | Marshall | 55/502 X |

FOREIGN PATENT DOCUMENTS

| | | | |
|---|---|---|---|
| 387245 | 2/1933 | United Kingdom | 55/374 |

*Primary Examiner*—Chris K. Moore

*Attorney, Agent, or Firm*—Alfred E. Miller

[57] ABSTRACT

A vacuum cleaner comprising a fan assembly which via a chamber encloses a dust container and communicates with an inlet sleeve for dust laden air. The inlet sleeve is via a hose connected to the nozzle of the vacuum cleaner. The walls of the chamber are provided with guides for a stiff collar which is part of the dust container. The guides extend mainly perpendicular to the axial direction of the inlet sleeve. The vacuum cleaner also includes a flexible inflatable means which is placed about the inlet sleeve. When starting the fan the flexible means is inflated by means of the pressure difference between atmosphere and the chamber thereby preventing dust laden air from flowing outside the dust container.

7 Claims, 2 Drawing Sheets

DEVICE FOR A VACUUM CLEANER AND A DUST BAG

This invention relates to a vacuum cleaner comprising a fan assembly which via a chamber enclosing a dust container communicates with an inlet sleeve for dust laden air, said inlet sleeve via a hose being connected to the nozzle of the vacuum cleaner, the walls of the chamber being provided with guides for a stiff collar being a part of the dust container the guides extending mainly perpendicular to the axial direction of the inlet sleeve. The invention also relates to a dust container comprising an air transmitting bag which has an opening that is covered by a stiff collar with an inlet opening.

Conventional vacuum cleaners usually are provided with two different types of fastening arrangements for the dust container. One type is used on vacuum cleaners where the container cover is fixed to the inlet sleeve through which the dust laden air flows from the nozzle to the vacuum cleaner. This cover is pivotally fastened to the vacuum cleaner and the sleeve seals either directly against the dust container by means of a rubber seal or the like, or because the inlet sleeve is extended to a degree that this extension when closing the cover enters through an opening in a membrane fixed to the collar of the dust container.

At the other type of vacuum cleaners, to which the present invention relates, the inlet sleeve is a rigid part of the shell of the vacuum cleaner, the dust container being of the so called cassette type, i.e. the dust container is inserted and taken out perpendicular to the axial direction of the inlet sleeve. The dust container comprises a stiff collar with an inlet opening, the collar covering the opening of an air transmitting bag. When the dust container cover of the vacuum cleaner has been opened, this collar is inserted into two guides of the shell of the vacuum cleaner, these guides being so placed that the collar abuts the inlet opening of the sleeve.

However, in connection with the last mentioned type of vacuum cleaners it has proved that the collar does not always completely abut the inlet opening and moreover the collar may on certain occasions be deformed and completely lose contact with said sleeve, which means that the dust laden air will be drawn on the outside of the dust container and flow through the fan which causes damages to the fan and the motor, particularly with respect to the bearings, and moreover this means that the dust laden air is returned to the room.

The purpose of this invention is to create an arrangement for the last mentioned type of vacuum cleaners where the dust laden air is prevented from flowing around the dust bag.

Some embodiments of the invention will now be described with reference to the accompanying drawing where FIG. 1 is a section through a first embodiment of the invention.

Figure 1:
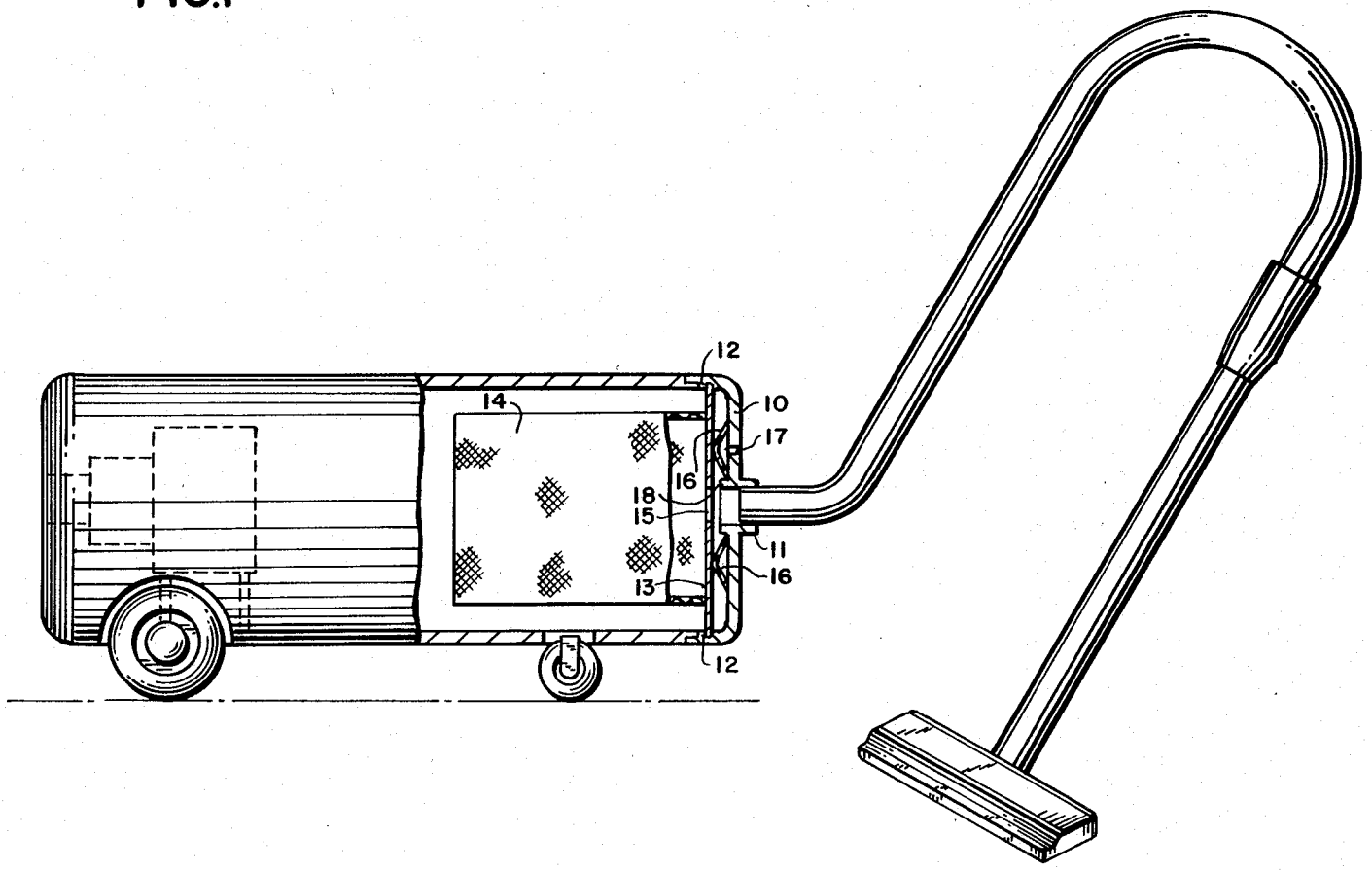

As appears from FIG. 1 the vacuum cleaner comprises a shell 10 with an inlet sleeve 11 for dust laden air. In the shell there are opposite grooves 12 in which a collar 13 of a dust container 14 is inserted perpendicular to the axial direction of the inlet sleeve 11. In the flow direction seen after the dust bag there is a fan assembly not shown. The collar 13 has a central opening 15 through which the air flows into the dust container. The opening of the inlet sleeve is surrounded by a flexible annular shaped membrane 16 the outer and inner peripheries of which are fixed to the shell of the vacuum cleaner. Through the shell 10 a channel 17 extends from the outside of the vacuum cleaner to the part of the membrane which is not fixed whereby atmospheric air communicates with one side of the membrane.

When the fan assembly is started this means that a negative pressure is created in the inlet sleeve 11, and in the dust container 14, between the dust container and the fan assembly and between the collar 13 and the shell 10 which means that the atmospheric pressure inflates the flexible membrane 16 so that it abuts and seals against the collar 13 in a manner as shown in the figure. Thus, this seal prevents the dust laden air from leaking beside the dust bag to the fan assembly through the slot 18 which is created between the inlet opening and the collar.

Figure 2:
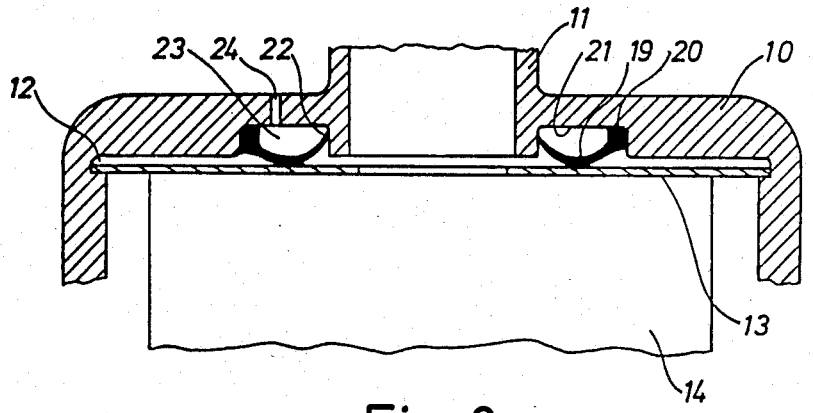
FIG. 2 is a section through a second embodiment.

According to the arrangement shown in FIG. 2, the flexible means instead comprises an arched ring 19 of flexible material, preferably plastic, the outer periphery of the ring being connected to a circular bead 20 which is inserted into an annular recess 21 which in turn is coaxial with the inlet sleeve 11. The inner periphery of the ring 19 which is shaped as a lip converges continously and abuts a cylindrical wall 22 which is concentric to the inlet sleeve. Between the ring 19 and the shell 10 an annular chamber 23 is created. The chamber is via a channel 24 connected to atmosphere. The ring 19 is expanded by sliding its inner part on the wall 22 towards the collar when the vacuum cleaner is started.

This embodiment has the advantage that no glueing methods need to be used in order to fasten the membrane in the vacuum cleaner which facilitates mounting. It is also possible to place the sealing surface at the outer periphery of the ring whereas the bead is placed at the inner periphery.

Figure 3:
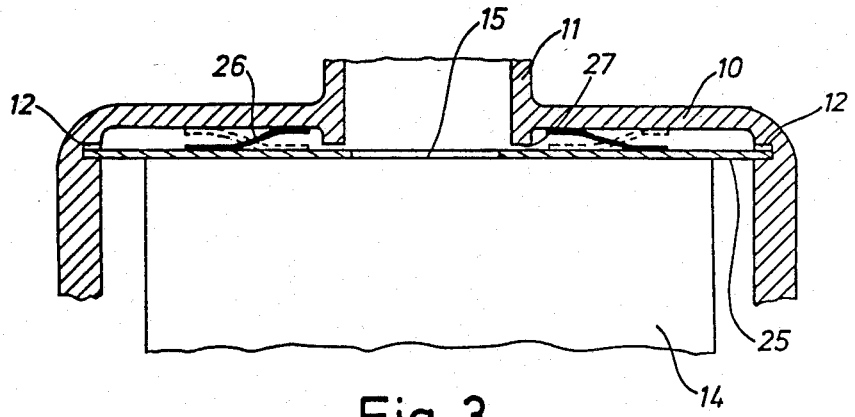
FIG. 3 is a section through a third embodiment of the invention.

According to the embodiment shown in FIG. 3 the vacuum cleaner has, as the embodiments above, a shell 10 with a fixed inlet sleeve 11 for the dust laden air, the shell being provided with grooves 12 in which a collar 25 of a dust container is inserted. The collar 25 has, as well as in the previously described embodiments, a central opening 15 through which the dust-laden air flows into the bag. Moreover, the collar is on its outside provided with a ring shaped membrane 26 the outer periphery of which is fixed to the collar. This embodiment works in the following way. If the collar 25 does not abut the inlet sleeve 11, air with high velocity will flow through the slot 27 created above the collar which means that the membrane 26 on the upper side of the collar is exposed to negative pressure lifting the membrane so that it abuts the shell 10. Thus, also here a seal is achieved preventing the air from flowing outside the container 14.

It is, of course, also possible to fasten the outer periphery of the annular shaped membrane in the vacuum cleaner about the inlet sleeve 11 so that the membrane upon starting up of the motor has its inner periphery abutting the collar 25 as seen in dotted lines in FIG. 3.

We claim:

1. In a vacuum cleaner having a housing, a motor fan assembly in said housing, a chamber having a dust container therein provided with a rigid collar having an opening for the passage of dust-laden air, an inlet sleeve in said housing through which is adapted to pass dust laden air, said inlet sleeve being connected to a nozzle through a hose, opposite walls of said chamber being provided with retaining means for removably holding said rigid collar of said dust container, said retaining means extending subtantially perpendicular to the longitudinal axis of said inlet sleeve, the improvement comprising a flexible and inflatable blocking means which is positioned about said inlet sleeve, comprising but spaced laterally therefrom, a channel in said housing open to the atmosphere and communicating with the surface of the blocking means proximate to said channel, and upon operating of said motor-fan said blocking means is expanded axially to abut said collar due to the pressure difference between the atmosphere and the interior of said chamber whereby dust laden air is prevented from flowing about the outside of said dust container.

2. A vacuum cleaner as claimed in claim 1 characterized in that the flexible blocking means comprises a membrane.

3. A vacuum cleaner as claimed in claim 1 characterized in that the flexible blocking means comprises a ring in which the outer part of the ring is in sliding engagement with a sealing surface and for its expansion being movable in axial direction towards the dust container.

4. A vacuum cleaner according to claim 3 characterized in that the housing is provided with an internal recess and the ring further comprises a lip and a bead which is inserted into said recess having a wall with which said lip is in sealing engagement.

5. A vacuum cleaner according to claim 4 characterized in that an annular chamber is created between the flexible blocking means and the recess, and said chamber communicating with the atmosphere through said channel.

6. A disposable dust container for a vacuum cleaner comprising a dust bag of air transmitting material the opening of which is covered by a stiff collar with an inlet opening and a flexible blocking means, said stiff collar supporting said flexible blocking means which is located about said inlet but spaced laterally therefrom, and which by means of existing pressure differences when operating said motor-fan assembly of the vacuum cleaner is expanded outwards from the collar in a direction substantially perpendicular to said collar for sealing engagement with the housing of said vacuum cleaner.

7. A disposable dust container according to claim 6 characterized in that the flexible blocking means comprises an annular membrane which is connected to the collar at its outer periphery.

* * * * *